US006796240B2

(12) United States Patent
Sainio et al.

(10) Patent No.: US 6,796,240 B2
(45) Date of Patent: Sep. 28, 2004

(54) PRINTING PRESS REGISTER CONTROL USING COLORPATCH TARGETS

(75) Inventors: Jeffrey W. Sainio, Milwaukee, WI (US); John C. Seymour, Jefferson, WI (US); Randall W. Freeman, Oconomowoc, WI (US)

(73) Assignee: Quad/Tech, Inc., Sussex, WI (US)

( * ) Notice: Subject to any disclaimer, the term of this patent is extended or adjusted under 35 U.S.C. 154(b) by 333 days.

(21) Appl. No.: 09/873,446

(22) Filed: Jun. 4, 2001

(65) Prior Publication Data

US 2002/0178952 A1 Dec. 5, 2002

(51) Int. Cl.[7] ..... B41F 1/34

(52) U.S. Cl. ..... 101/485; 101/486; 101/484; 101/181; 101/211; 382/151

(58) Field of Search ..... 101/485, 486, 101/483, 248, 286, 481, 484, 170, 171, 180–183, 211, 216; 364/469, 469.03, 469.04, 526, 559, 525; 382/112, 151, 162, 167

(56) References Cited

U.S. PATENT DOCUMENTS 3,393,618 A 7/1968 Baker
4,469,025 A 9/1984 Loffler et al.
4,736,680 A 4/1988 Wales et al.
4,852,485 A 8/1989 Brunner
4,857,997 A 8/1989 Fukami et al.
4,881,181 A 11/1989 Jeschke et al.
4,885,785 A 12/1989 Reynolds et al.
4,887,530 A 12/1989 Sainio
5,029,527 A 7/1991 Jeschke et al.
5,125,037 A 6/1992 Lehtonen et al.
5,181,257 A 1/1993 Steiner et al.
5,412,577 A 5/1995 Sainio et al.
5,689,425 A 11/1997 Sainio et al.
5,724,259 A 3/1998 Seymour et al.
5,946,537 A 8/1999 Nakayasu et al.
5,967,049 A 10/1999 Seymour et al.
5,967,050 A 10/1999 Seymour
5,992,138 A * 11/1999 Bruckner et al. ..... 60/783
6,109,183 A 8/2000 Papritz et al.
6,129,015 A * 10/2000 Dewey ..... 101/211
6,178,254 B1 * 1/2001 Rappette et al. ..... 382/112

OTHER PUBLICATIONS

QUAD/TECH Press Controls for the Forms Industry, brochure, 1992, QUAD/TECH, Sussex, WI, USA.

* cited by examiner

*Primary Examiner*—Minh Chau
(74) *Attorney, Agent, or Firm*—Michael Best & Friedrich LLP

(57) ABSTRACT

By inclusion of a register target within a colorpatch, a colorbar is used for controlling color register as well as controlling color density on a printing press.

15 Claims, 8 Drawing Sheets

PRINTING PRESS REGISTER CONTROL USING COLORPATCH TARGETS

FIELD OF THE INVENTION

The present invention relates generally to a system and method which utilizes the colorpatches of a colorbar for both color control and ink register control.

BACKGROUND OF THE INVENTION

The field of web offset printing has seen great benefit from the revolution in computer electronics. As a result of the ever decreasing cost of electronics, sensing technology, and particularly computing horsepower, tasks formerly done by pressmen are increasingly performed by machines. Because human perception or bias is no longer involved in many of the quality control functions of printing, the consistency of the printing operation is increased. In turn, publishers have taken advantage of this increased consistency to minimize the amount of wasted paper that formerly was allocated for quality control purposes.

Some quality concerns revolve around the characteristics of the inks applied to a web which is typically paper. These ink characteristics include the strength or saturation of the ink (which is controlled by the thickness of the ink film, in turn controlled by ink dosing mechanisms within the print units), trap (which is a measure of the ability of an ink to be printed on top of a previously printed ink as compared to being printed on uninked paper), slur or doubling (which appears as a smearing of the ink), register (which is the relative positions of the inks to each other and is also known as print-to-print register or color register), backup or through-the-sheet register (which is the positions of the inks on the top side of the sheet relative to the bottom side of the sheet), and print-to-cut register or cutoff (which is the relative positions of the ink to the position where the web is cut into sheets).

Areas of the web are generally allocated for quality control purposes and include form ID numbers, laps which are used to open a folded form for saddle-stitching, cutoff control targets used to ensure that the web is properly cut into sheets at the correct position, color register targets used by a color register control system to assure proper alignment of the various colors relative to each other, and colorbars used to verify and control ink feed to the printing units.

Cutoff control targets used in a cutoff control system are generally contrasting rectangular marks placed on a lap. The position of the marks is determined and compared to their respective desired position. Web compensators are commanded to move in a manner to adjust any circumferential or print-to-cut register error. As a result, the web is properly cut into sheets, and the printed material on the sheet registers to the cut edge.

Color register targets for a color registration system are generally full-tone small marks of the individual inks of predetermined shape, such as dots, squares, triangles, or diamonds. The positions of the marks relative to each other are determined and compared with desired positions to maintain the respective colors in proper relative alignment. Color register control is differentiated from color density control in that the former controls the positions of the inks with respect to one another and the latter controls the ink film thickness, the strength or the saturation of the inks applied to the web.

A colorbar, used for monitoring color quality, is a lateral sequence of small colorpatches, typically rectangular, of the various color inks printed substantially fully across the web in a direction perpendicular to the direction of web travel. The colorpatches are printed in varying combinations, and have been used for measuring ink density or controlling the dosage of ink to the various alleys of the web, and optionally for measuring or controlling other ink characteristics. An alley or key area is a circumferentially extending strip of the web that is inked by a particular ink dosing mechanism or ink key. Numerous alleys comprise the printable surface of the web. A typical method used to measure the optical density of the ink utilizes either a densitometer off-line of the web printing process or a color video camera on-line.

In lower quality printing, such as newspaper printing, a halftone overprint of the cyan, magenta, and yellow inks is printed as a bar, often near a reference bar of black ink. Since newspapers are not typically trimmed, such a bar may be camouflaged as a part of the masthead. The bars typically appear gray and variations from gray in the balance of the color are usable for color control purposes.

Typically, in high quality web offset printing, ink colorpatches are printed at full-tone or 100% strength, at 75% and 50% halftone strengths, and in various patterns to measure such parameters as color strength, trap, print contrast, slur, and dot gain.

Various closed-loop printing press quality control systems are shown in U.S. Pat. Nos. 4,885,785, 4,887,530, 5,412,577, 5,689,425, 5,724,259 and 5,967,050.

The cutoff control system described in U.S. Pat. No. 4,885,785 is capable of using either a discrete cutoff mark, or the printed image itself, as the target whose position is determined. To reduce paper waste, the printed image itself is used rather than a discrete cutoff mark.

The register control system described in U.S. Pat. No. 4,887,530 uses discrete register marks. These discrete marks are typically placed on a lap, or if space is at a premium in a particular run, these marks are embedded in the colorbar, replacing some colorpatches in the colorbar.

The color measurement system described in U.S. Pat. No. 5,724,259 has been found to be accurate with a colorbar as narrow as 1/16 inch high. The colorbar is typically placed at the position where the paper will be cut into individual sheets so that ordinarily 1/32 of an inch of the colorbar will appear at the top of a sheet, and 1/32 of an inch of the next colorbar will appear at the bottom of the sheet. Because more than 1/32 of an inch of paper is typically trimmed from a sheet to form a final book or magazine, the colorbar incurs no additional paper waste. To minimize paper waste, the printed image is typically printed to abut directly to the edge of the colorbar. Combined with a system to control the ink-feed mechanisms of a press, a color measurement system becomes a color control system which controls the strength or saturation of the ink in the various alleys of the web. Such control of inking levels is well known and details may be found in U.S. Pat. Nos. 4,881,181 and 5,029,527.

A small colorbar has a disadvantage. When a press run is first started, the various colors of the printing units are usually misaligned or misregistered with respect to each other. If circumferential misregister causes the printed image to overlay or bleed directly into the top and bottom of the colorbar, with no bordering white space as a buffer, the colors of the misregistered image will contaminate the colors of the colorbar, preventing proper operation of the color control system. If lateral misregister causes the colorpatches to overlay each other, the sampled colors are similarly contaminated by each other. A certain minimum area of uncontaminated color is needed as a sufficient sample to accurately determine color density. Color measurement or control therefore cannot commence until the registration is manually or automatically performed. If register targets replace colorpatches in the colorbar, these targets may similarly be contaminated by bleed, preventing their recognition. In this situation both register and color control are inoperative, requiring manual intervention.

An abutted colorpatch in itself is not a reliable register target, since it is adjacent to, or in the case of circumferential misregister, partially overlaid by the printed image. Since the printed image may be of a similar color to the colorpatch, the colorpatch may have little contrast against the image, preventing the colorpatch's edges, and therefore its position, from being accurately determined. Similarly, a dedicated register target in the colorbar is unreliable, unless it is small enough that its edges are not abutted by the printed image under worst-case misregister. Due to the limited resolution of printing, such a small target cannot have a complex shape, so there is a risk that the printed image may coincidentally have a similar misleading shape. The register system will malfunction if target misrecognition occurs.

The markless register control systems described in U.S. Pat. Nos. 5,412,577 and 5,689,425 use the printed image itself as the source of register information.

The web in a printing press is subject to lateral and circumferential shifting, especially at critical times of startup, so that any mark on the web may not be in an expected position. If a mark is small as is usually desired, and the control system images only a small area of the web, as is typically needed for adequate camera resolution, then searching for the mark is required. A strobe light can be used to image register marks or target areas on a small area of a web. If the marks are not found, a 2-dimensional search, i.e., in both the lateral and circumferential directions, is required because the marks could have moved in any direction. Searching for marks can be time consuming and costly.

Closed-loop printing press quality control systems are typically embodied in a structure or stand which contains the needed scanners, controls, and electronics. The size of the stand can vary considerably, and the control system components are typically mounted wherever free space is available. If a control system is to be retrofitted onto an existing press, the floor space may be unavailable. Floor space may be minimized by stacking the various components atop one another. Stacked components are less accessible for cleaning, web-up, or inspection. Each control system also requires regular maintenance because printing presses generate paper dust and tiny droplets of ink, both of which obscure the optics of the various scanners. To minimize floor space, U.S. Pat. No. 5,125,037 describes a single system for both color and register control purposes. This system uses large amounts of expensive white space between targets so that the problem of bleed does not occur, and does not disclose methods of recognizing a target buried in bleed. U.S. Pat. No. 6,109,183 also describes a single system for both register and color control purposes, and likewise does not disclose methods of recognizing a target buried in bleed.

One current trend in web offset printing is the use of wider web widths. A decade ago, the typical high-speed web offset press was capable of printing a 38-inch wide web, or four typical magazine pages wide. The current standard is to print a 54-inch wide web, or six magazine pages. A wider width emphasizes several errors common in offset lithography. One problem is called cocking register error wherein one ink color in the printed image is skewed slightly with respect to the others. Register of a color may be correct at the left side of the web but be offset vertically on the right side. This problem is corrected by skewing the plate cylinder of the press in the opposite direction. There are various causes for a cocking error including a printing plate being incorrectly imaged or installed, or uneven paper characteristics.

Another problem prevalent in wider webs is called fit register error in which the colors' register will be correct at the center of the web, but the later-printed colors will misregister toward the edges of the web. This is due to an inherent part of lithography in that water and ink are used in the process, and water causes the paper web to widen. Because the web is wider at the last printing unit than the first, having absorbed more water, the later-printed colors are relatively narrower. This problem is addressed with the use of bustle wheels. The bustle wheels are mounted below the web and are adjusted to impinge upon the web creating a slight wrinkle. The bustle wheels are placed in a position, such as a fold or cut line, where the wrinkle will not be noticed in the final product. The wrinkle takes up paper laterally, approximately shrinking the paper back to proper size. On presses such as the Lithoman 64, produced by M. A. N. Roland of Augsburg, Germany, such bustle wheels are motorized, allowing remote operation.

Register systems which scan only a single set of register marks cannot determine fit or cocking register error. Comparison of register on one side of the web with the register on the other side of the web is needed to determine cocking and fit register error.

SUMMARY OF THE INVENTION

The preferred embodiment of the present invention utilizes colorpatches for both color control and register control. Color measurement steps are used to determine the color density of colorpatches, while the same colorpatches are used to determine the respective positions of each ink color. If the printed image bleeds into and contaminates the upper or lower edges of the colorbar, or if lateral misregister acts to partially overlay one colorbar atop an adjacent colorbar to the left or right, the positions of the colorbars can be accurately determined with respect to each other, corrections can be sent to the register-correcting motors of the printing units, and the misregister corrected. With correct register, the colorbars are not overlaid by the printed image or each other, allowing for accurate color measurement and control.

In the preferred embodiment, distinguishing attributes are embedded in the colorpatches and are left uninked to improve the determination of colorpatch position despite impingement of the colorpatch by image bleed or another colorpatch. Limitations of the prior art are avoided by a two-step process of recognition of the distinguishing attribute. First, an approximate determination of the position of the colorbar (and therefore the distinguishing article which is in a known positional relationship to the colorbar) is made. Second, an exact determination of the position of the distinguishing article is made. Since the approximate position of the distinguishing attribute is known with respect to the colorbar, only a small area need be examined to exactly determine position.

Because the entire width of the web is preferably scanned in normal operation to control the color of the various alleys of the web, fit and cocking register errors can also be determined. Since the same scanner is used for both color and register control, equipment complexity and maintenance duties are minimized.

Features and advantages of the invention will become apparent to these of ordinary skill in the art upon review of the following drawings, detailed description and claims.

Figure 1A:
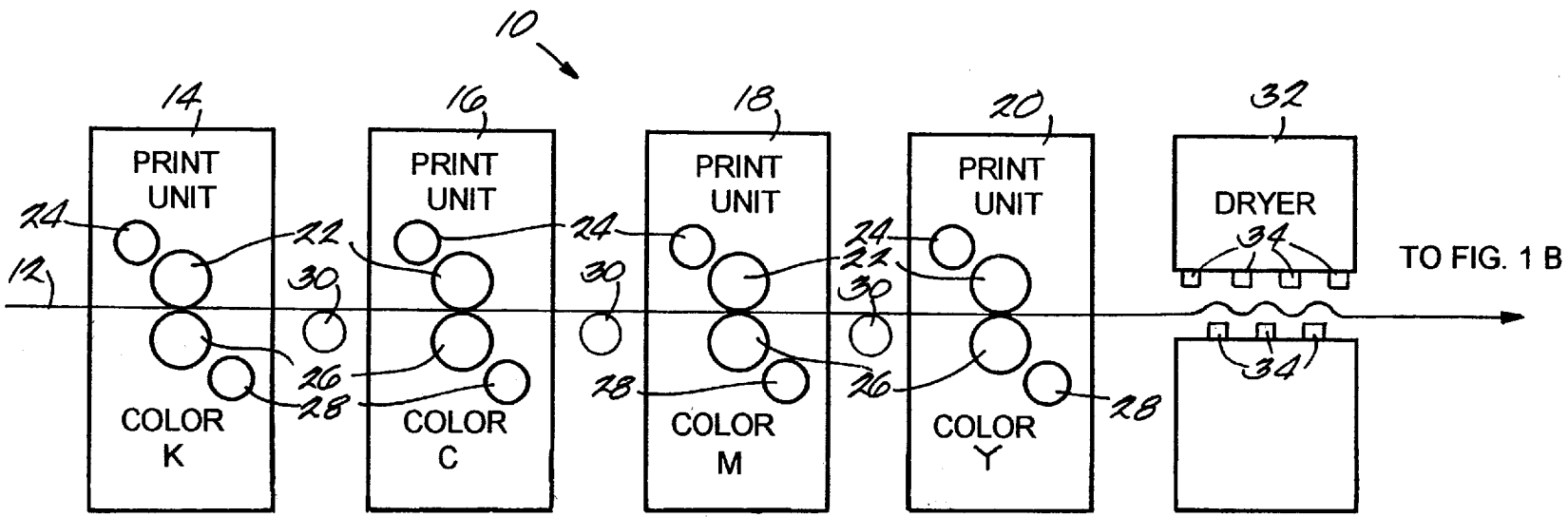
FIGS. 1A and 1B are schematic views of a web printing press.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

Referring to FIG. 1A, a printing system 10 for printing a multicolor image upon a web 12 is illustrated. Typically, four printing units 14, 16, 18, and 20 each print one color of ink that make up the image printed on the web 12. This type of printing is commonly referred to as web offset printing. Each printing unit 14, 16, 18, 20 includes an upper blanket cylinder 22, an upper printing plate cylinder 24, a lower blanket cylinder 26, and a lower printing plate cylinder 28. In printing system 10, colors K, C, M, and Y on units 14, 16, 18, and 20 respectively, are typically black (K), cyan (C), magenta (M), and yellow (Y). Bustle wheels 30 typically impinge on the bottom of the web 12. The location of printing units 14, 16, 18, and 20 relative to each other is determined by the printer, and may vary. Additional colors may be added, as necessary. After printing, the web 12 passes through a dryer 32 which removes the solvents from and sets the ink. The dryer 32 generally contains airbars 34 which blow hot air alternately at the top and bottom of the web 12. The alternate pressure of the hot air gives the web path a serpentine or sine-wave shape. The sine-wave shape effectively forms a spring which stretches depending on web tension. Varying stretch causes inconsistency in the cutoff of the web 12 as it is cut into sheets. After passing through the dryer 32, the web passes over chill rolls (not shown) which cool the web, and web guides (not shown) which maintain the lateral position of the web 12.

Figure 1B:
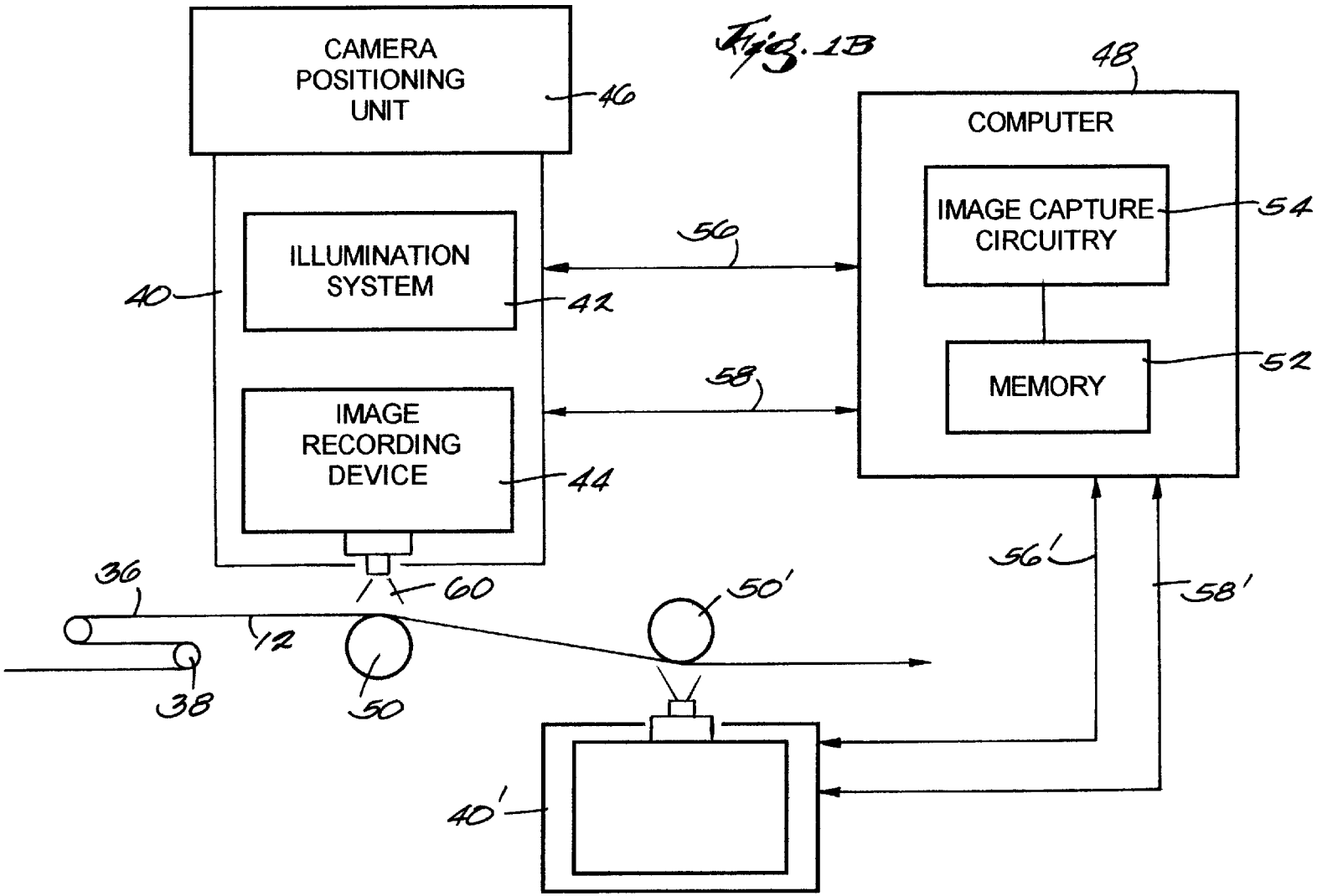

Referring now to FIG. 1B, the web 12 then passes through a web compensator 36 having a lower roller 38 which is movable in the direction of the paper. By moving roller 38, the effective length of the web 12, and therefore the cutoff, can be adjusted.

Printing system 10 includes a camera assembly 40 in optical communication with the top side of the web 12. The camera assembly 40 includes an illumination system 42, preferably using a timing strobe light, an image recording device 44, such as a video camera, and a camera positioning unit 46. Printing system 10 includes a computer 48, and an idler roller 50. The computer 48 may be of a conventional type including a Pentium® microprocessor, memory 52 and a PC architecture. Computer 48 includes image capture circuitry 54 which interfaces with the camera assembly 40. Another camera assembly 40' may also be used such that it is in optical communication with the bottom side of the web 12 at a predetermined location relative to camera assembly 40. Camera assembly 40' operates in a substantially identical way to camera assembly 40.

After passing through the camera assemblies 40 and 40', the web 12 continues downstream in the printing process, and may be coated with silicone, slit, cut, folded, and stacked. The order of the various processing components may vary, or be totally absent, depending on the specific design of the printing system and the needs of a particular print run.

In general operation, the image recording device 44 is used to obtain an image signal which is a representation of a printed image on the web 12. In particular, computer 48 is connected to the camera positioning unit 46 by data bus 56. The computer 48 sends control signals to the camera positioning unit 46. The camera positioning unit 46 moves the camera assembly 40 in a lateral direction (perpendicular to the web motion) to various positions across the web 12. The portion of the web imaged is that portion of the web passing idler roller 50. This portion of the web is illuminated by the illumination system 42 and the image recording device 44 records an image signal which is representative of the printed portion of the web 12 within the field of view 60.

The camera assembly 40 obtains an image signal for the printed image within the field of view 60 for various positions of the camera assembly 40 across the web 12. Web 12 is moving in the longitudinal direction and longitudinal positioning by camera positioning unit 46 is not necessary because the timing of the light in the illumination system 42 effectively provides longitudinal positioning relative to moving web 12. The purpose of moving the camera assembly 40 laterally across the web 12 is to allow selective image recording of lateral portions of the printed image on web 12. The illumination system 42 is synchronized with the movement of the web 12 such that the recorded image signal includes a portion of a colorbar.

Optionally, continuous illumination may be provided and electronic shuttering of the camera assembly 40 may replace the strobing function. It should also be noted that the camera positioning unit 46 may not be needed, provided the image recording device 44 has a sufficient field of view to image all necessary colorpatches or if multiple image recording devices 44 are utilized.

The image recording device 44 is preferably a CCD color video camera having red, green, and blue color channels such as a SONY XCO03 3-chip CCD color video camera including a dichroic prism to separate received light into the separate color channels. However, it should be noted other types of image recording devices can also be utilized. In particular, a single chip color camera may provide adequate spatial resolution and color response for a given application. Each color channel is coupled to the computer 48 and image capture circuitry 54 via signal bus 58. For maximum resolution, image recording device 44 preferably uses independent imagers for each of the red, green and blue components using dichroic beam splitters such as disclosed in U.S. Pat. No. 4,857,997. A preferred embodiment of the camera 36 and camera positioning unit 46 may be found in U.S. Pat. No. 5,724,259, which is hereby incorporated by reference.

Image capture circuitry 54 includes image capture boards which are connected to the expansion bus of computer 48. By way of example, the image capture circuitry 54 may be of the bus board type manufactured by Synoptics of England SPR4000SCIB with 32 MEG RAM which includes an A/D converter.

Signal bus 58 transmits recorded image signals from camera assembly 40 to the computer 48, and camera control instructions from computer 48 to camera assembly 40. Image capture circuitry 54 is configured to produce a captured image array by converting the recorded image signals from the video camera into an array of digital signals, such as of size 640 pixels by 480 pixels. Three arrays are generated corresponding to information from each of the three color channels. Each pixel is associated with an 8-bit gray level which is representative of the amount of light reflected from the corresponding area of the printed image within the field of view 60 and onto the corresponding CCD imager.

Figure 2:
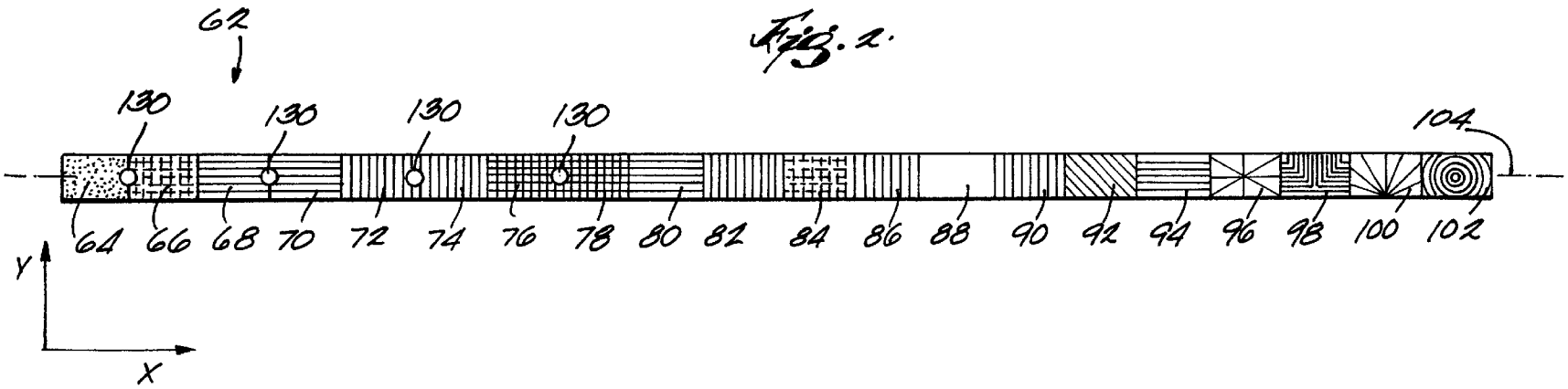
FIG. 2 illustrates an example of a colorbar.

Turning now to FIG. 2, an example of an embodiment of a colorbar 62 is shown. Generally rectangular colorpatches are arranged side by side to form a colorbar 62 spanning laterally across the web 12. It should be noted that other shapes of colorpatches, in addition to rectangular, could also be used. Typically, this series of colorpatches is repeated across the web 12. Colorbar 62 includes cyan (C), magenta (M), yellow (Y), and black (K) components. By way of illustration, the colorbar 62 may include the following colorpatches: K100% 64, K75% 66, C100% 68, C75% 70, M100% 72, M75% 74, Y100% 76, Y75% 78, C50% 80, K50% 82, Y50% 84, M50% 86, a white patch (uninked paper) 88, M100%Y100% (with a red result) 90, C100%Y100% (with a green result) 92, C100%M100% (with a blue result) 94, Kslur 96, Cslur 98, Mslur 100, and Yslur 102, (each showing a different type of slur target; normally only one type is used on a colorbar), where K100% represents full tone of the black ink, Y50% represents half tone of the yellow ink, C100%M100% represents full tone of both cyan and magenta ink, and slur represents a slur target of the color.

Optionally, the colorbar 62 can be defined by the CIP3 print production standard (section 3.4.4 and 3.4.5), a specification of the Fraunhofer Institute for Computing Graphics available at www.cip3.org, or various other colorbars designed for specific needs.

The field of view 60 of the camera assembly 40 is preferably aligned with the longitudinal axis 104 of the colorbar such that the representation of the colorbar 62 in the captured image array is located in adjacent rows of the captured image array. Only a portion of the colorbar 62 will be within the field of view 60. Preferably, the lateral direction on the web 12 is aligned with the X direction of the camera assembly 40 and the circumferential direction on the web 12 is aligned with the Y direction of the camera assembly 40, as best shown in FIG. 2.

In the present invention, the computer 48 is suitably programmed to determine both the density and position of each colorpatch in the colorbar 62 by analyzing the colorbar representation contained in the captured image array. The steps and processing involved in this analysis are best outlined in FIGS. 3A, 3B and 4.

Figure 3A:
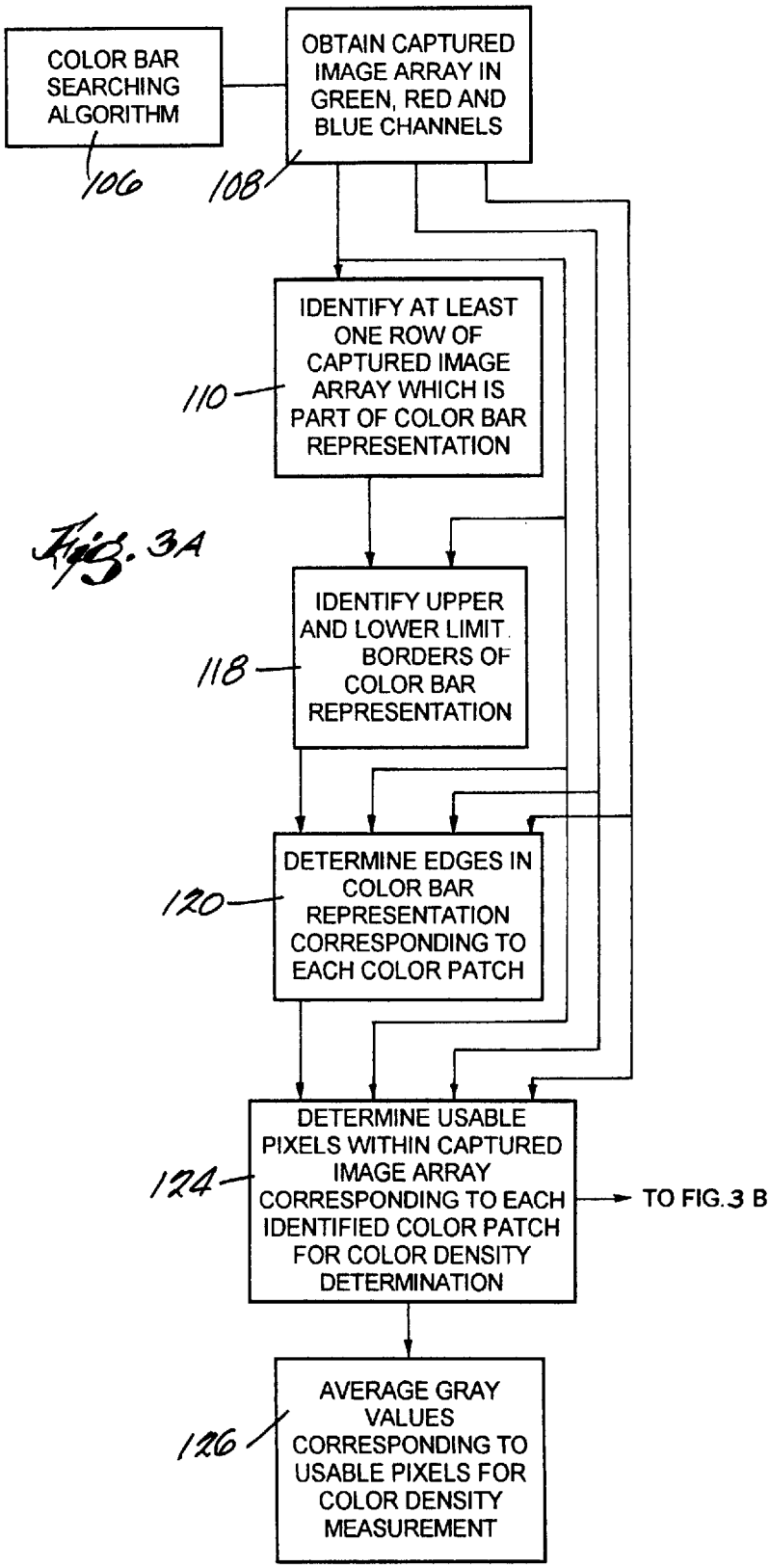
FIGS. 3A and 3B are flowcharts of a process of analyzing a colorbar.
Figure 4:
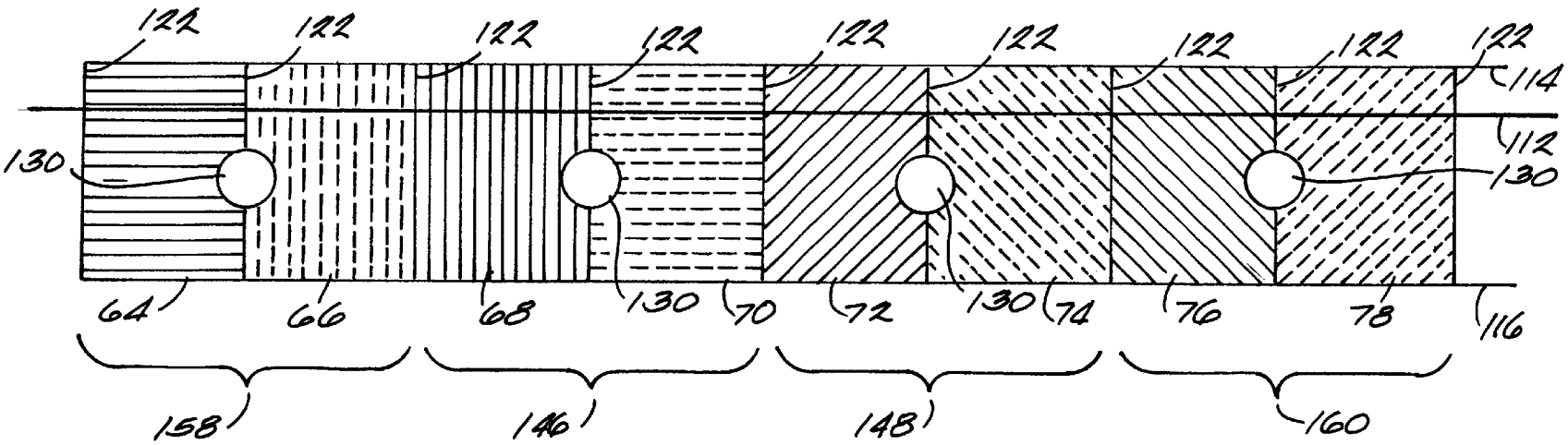
FIG. 4 illustrates a portion of a colorbar.

Turning now to FIGS. 3A and 4 in particular, at step 106, a colorbar searching algorithm, as will be explained in more detail hereafter, insures that a portion of the colorbar 62 is within the field of view 60 of the camera assembly 40. At step 108, the camera assembly 40 captures the printed image within the field of view 60 to obtain a captured image array for each of the green, red, and blue color channels. At step 110, the green channel is preferably selected to be analyzed to identify at least a single row 112 (FIG. 4) of the captured image array containing the colorbar representation. Once one row 112 of the colorbar representation is found, the upper limit border 114 and lower limit border 116 of the colorbar representation are determined in step 118, again preferably using the green channel. All of the color channels are used in step 120 to determine the edges 122 corresponding to each colorpatch in the colorbar representation. In step 124, the usable pixels within the captured image array corresponding to each identified colorpatch are determined. The usable pixels are those that will be used in a color density determination. In step 126, the gray values corresponding to each usable pixel are averaged to obtain a color density value for each identified colorpatch.

Figure 3B:
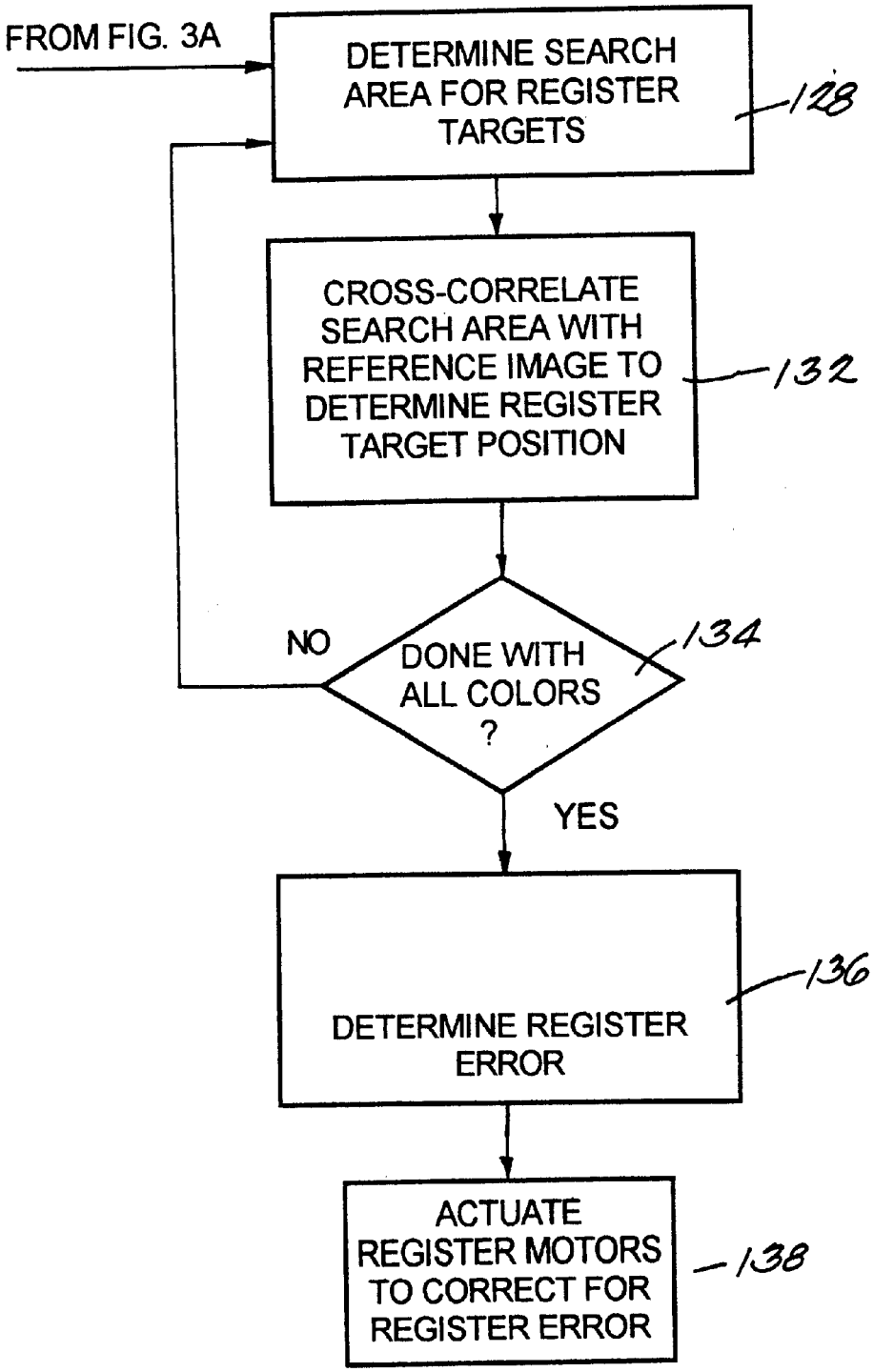

With reference now to FIG. 3B and step 128, the borders found in step 118 of the 100% and 75% patches of the same color are then examined in combination to define a search area for a distinguishing attribute 130 positioned between colorpatches. In step 132, the search area is then preferably cross-correlated with a reference or template image to determine the exact position of the distinguishing attribute 130. In step 134, steps 128 and 132 are repeated for each of the colors whose register is to be determined. The determined positions are then subtracted from the expected positions to generate a register error in step 136. In step 138, this error is compensated for by register motors on printing units 14, 16, 18, 20.

Turning back to FIG. 3A and step 106, the colorbar searching algorithm begins by collecting an image at one candidate position taken to refer to a particular timing between a press encoder signal and a strobe flash. The collected image is analyzed to determine whether the image contains a valid portion of a colorbar 62. Because the colorpatches of the colorbar 62 capable of determining register are in a known portion of the colorbar 62, the problem of two-dimensional searching for the distinguishing attributes 130 is simplified to a 1-dimensional search. On initial press startup, the colorbar searching algorithm (if needed) is performed in any ink key zone. In other words, because the colorbar 62 preferably reaches across the full width of the web 12, the search is only necessary in the circumferential dimension. Once the colorbar has been found, the X-location (or lateral location) is determined by image-recognition of the colorbar pattern.

If the colorbar 62 has been found, its vertical position is noted and the strobe firing position is amended so as to bring the colorbar 62 to the center of the captured image array. This is the calibrated position which is used for subsequent image collection.

If the colorbar is not found, the position is incremented so as to collect an image which has partial overlap with the first image. The process is repeated until either the colorbar 62 is located or the images have been collected which cover all positions on the printing cylinder 24. If the latter occurs, an error is reported. This technique is known and described in U.S. Pat. No. 5,724,259, which has been incorporated by reference.

The field of view 60 of the camera assembly 40 is aligned with the axis 104 of the colorbar 62 such that the data representing the colorbar is located in adjacent rows of the captured image array. The captured image array contains a portion of the colorbar 62, which extends laterally across the web.

The exact positioning of the colorbar 62 within the field of view 60 is not initially known because of initial installation, web weave (lateral web movement), circumferential motion of web 12, or misregister between colors. Thus, the X and Y-coordinates of the captured image array are not known. Therefore, the computer 48 is also suitably programmed to operate as a colorbar determination circuit to provide information regarding colorbar 62 location in the captured image array.

The colorbar determination circuit has three major steps, steps 110, 118, and 120. These steps are described in further detail in U.S. Pat. No. 5,724,259, which has been incorporated by reference. This referenced technique generates the upper and lower limit borders of the colorbar 62, as well as the approximate X-position and Y-position of the captured image signal array.

If the colorbar 62 is found, the difference between a previously known Y-position and the current Y-position represents the cutoff error. This error is only approximate but has sufficient accuracy for cutoff control, and may used to operate a motor on web compensator 36 to correct the cutoff error, as is well known in the art.

From the offset determined from the correlations in the first part of this algorithm, and from a description of the colorbar, the approximate location of each of the colorpatch edges can be calculated. The red, green and blue differentiated arrays are next searched in the area of each of the calculated colorpatch edges. The channel with the largest absolute peak will be the channel which is used to refine the location of this particular edge.

At this point, the approximate location of the top and bottom edge and the channel to be used are known. The approximate locations of the vertical edges are found by subtracting points which are approximately one patch width apart. The location of greatest change in brightness is taken as the approximate vertical edge location between the colorpatches. The X-offset is then used to correct the position of the camera assembly 40 using the camera positioning unit 46, so that on subsequent imaging of the web 12, the expected versus captured colorbar image will remain substantially aligned.

Optionally, rather than moving the camera positioning unit 46, a press web-guide, angle-bar, or other web steering device could be controlled to maintain the captured image in the expected position. In this case, the technique functions to control the lateral position of the web.

For step 124, and with reference to FIG. 6, the usable pixels are determined in the following manner. In order to compensate for the fact that pixels near the colorpatch edges might be contaminated by other patches or misregistered ink 140 and 142 bleeding into the colorpatch, the areas 144 that represent uncontaminated ink suitable for the determination of color density are determined. The edges of the patch are selectively narrowed in the following way. To determine which pixels might be excluded, a +/−20% color value limit is determined from each pixel to the next. Usable pixels are those having values falling within the +/−20% limit and the color values associated with the usable pixels are used for measurement of the colorpatch.

The above calculations are repeated for each of the edges in each continuous-tone colorpatch of the colorbar. The result defines the boundaries of the areas 144 of each of the colorpatches within which color density may be accurately measured.

Alternatively, the determination of pixels to exclude may be done more robustly by calculation of the Euclidean difference between the RGB values of one pixel to the next.

The optical density may now be calculated as the negative log of the relative reflectance (relative to a white patch 88) for each of the areas 144 inside the colorpatches. The calculated densities are used in conventional computations. For example, the solid ink density is compared to a desired ink density, such as a desired density of 1.2 in the case of yellow ink, and the inking level adjusted to correct for any density error. The solid ink density and the density of the corresponding 50% patch (for example, 64 and 82 for black ink) are together used to compute dot gain. The solid ink density and the density of the corresponding 75% patch (for example, 64 and 66 for black ink) are together used to compute print contrast.

The solid ink density of an overprint and the corresponding solid ink density are used to compute trap. Together with solid ink density, the dot gain, print contrast and trap may be used for quality control of the print run, for diagnosis of printing conditions or for control of inking levels.

For the colorpatches 64–102 to also be used to determine color register, they preferably have some distinguishing attribute whose position can be determined. Preferably, this attribute has minimal impact on the color accuracy read from the colorbar. Also, this attribute is preferably at a maximum distance from any bleed that could obscure it.

As shown in FIG. 4, preferably the colorbar 62 includes full-tone colorpatches 64, 68, 72, and 76, each adjacent to a 75% tone colorpatch 66, 70, 74, 78 of the same color, with each 100% tone/75% tone pair having the distinguishing attribute centered between them. For example, the distinguishing attribute can be a 0.02 inch diameter white (uninked) circle. In the case with a 1/16 inch (0.062 inch) colorbar, the image will be 0.021 inch above and below the distinguishing attribute. As reliable recognition can occur even with half the distinguishing attribute obscured by bleed, the maximum corrected misregister exceeds 0.030 inch, larger than typical misregister conditions encountered.

The determination of usable pixels using the +/−20% criteria will eliminate such a white area from being averaged into the color density. With only approximately 5% of any colorpatch area lost to the distinguishing attribute 130, the loss of accuracy in the color density determination is minimal. With the colorpatches to either side of the register target 130 of the same color, misregister does not corrupt the shape of the register target 130.

Figure 5:
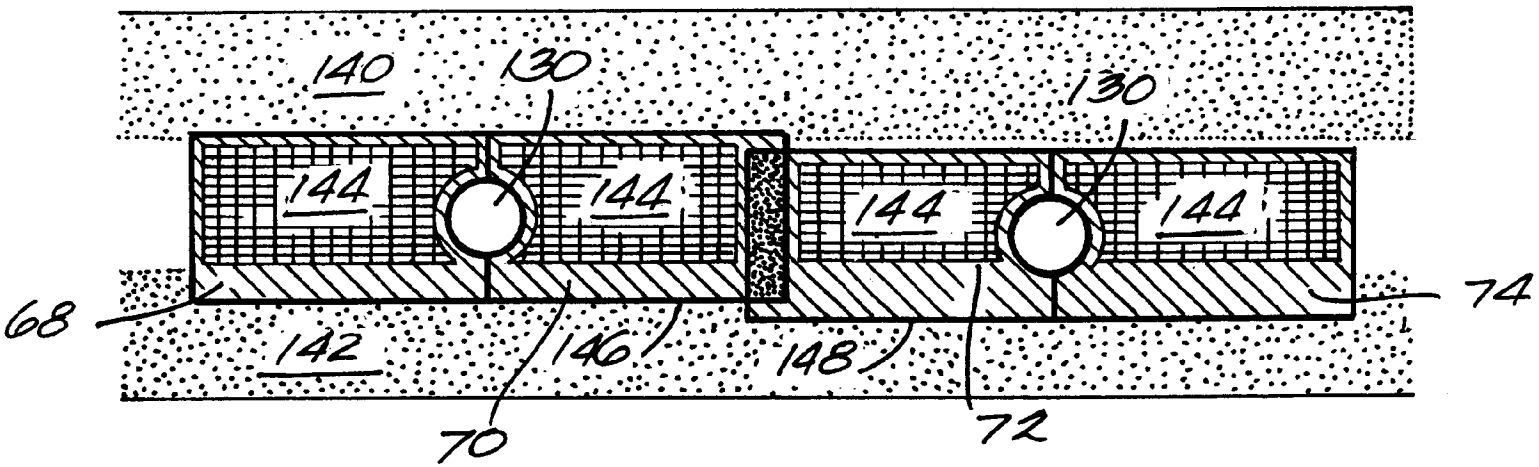
FIG. 5 illustrates a portion of a colorbar.

Referring now to FIG. 5, to determine the positional difference between, for instance cyan and magenta, the cyan ink 100% patch 68 and 75% patch 70, they are taken together as a unit 146, and the magenta ink 100% patch 72 and 75% patch 74 are taken together as a unit 148.

Figure 6:
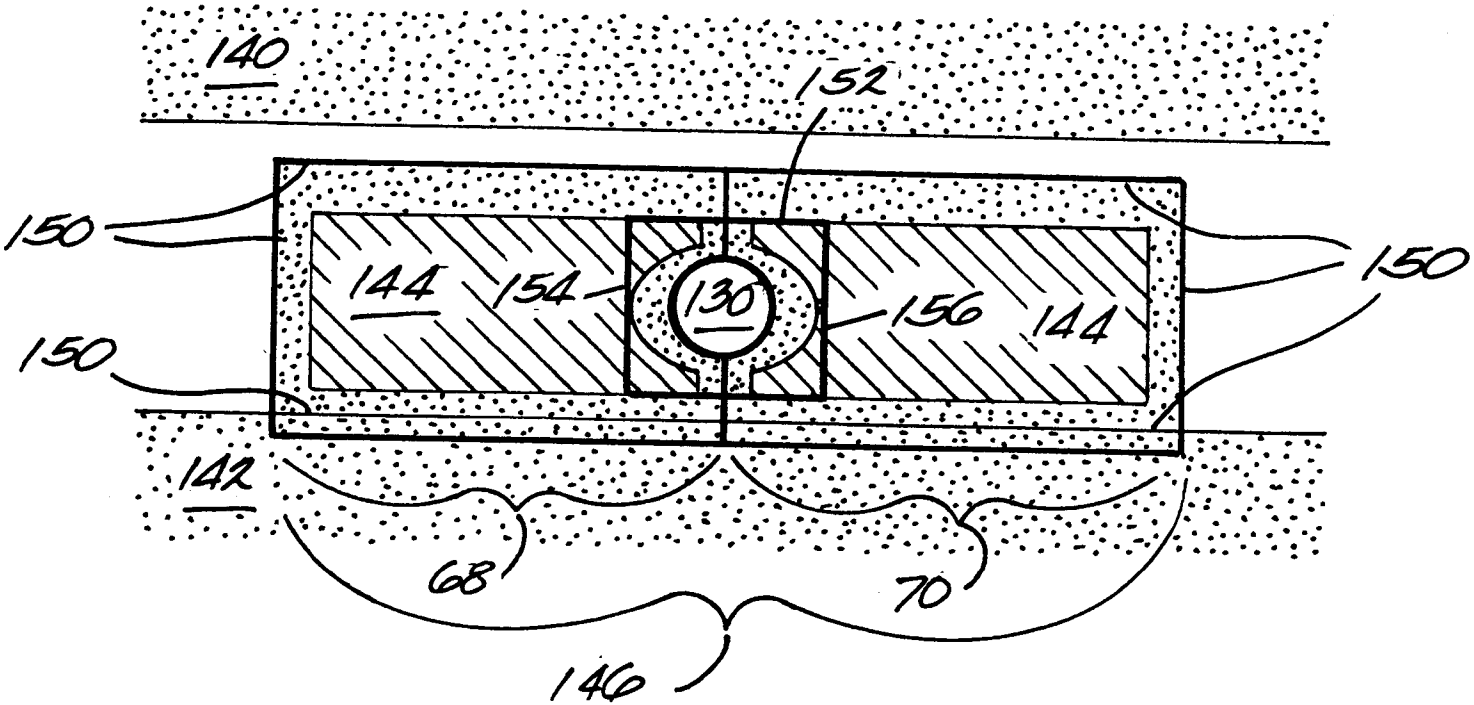
FIG. 6 illustrates a portion of a colorbar.

Referring in greater detail to FIG. 6, as an example, the cyan unit 146 is overlaid by image bleed 142 on its bottom side. As a result, the edges 150 of the patches 68 and 70 only provide the approximate position of the entire colorpatch, and therefore the edges 150 are not sufficiently accurate for use in color registration.

The preferred method of determining the exact position of the color unit 146 is to determine the position of the distinguishing attribute 130 which is shown as a circular white area. To perform this, in step 128, a rectangular area 152 is determined whose top and bottom are determined by the respective top and bottom of the usable color area 144 of patches 68 and 70 and whose sides 154, 156 are determined by the leftmost portion of the right side of area 144 of patch 70, and the rightmost portion of the left side of area 144 of patch 68. The distinguishing attribute 130, or in cases of severe circumferential misregister at least a portion of it, will be within rectangular area 152. Like area 150, area 152 only approximately describes the colorpatch position, however, being a smaller area provides faster data processing and minimizes the chance of containing misleading images.

In step 132, the position of the distinguishing attribute 130 is preferably determined with cross-correlation techniques.

To exactly determine the position of the distinguishing attribute 130, the region 152, as best viewed in the red channel in the case of cyan ink for example, is cross-correlated against a template which is simply an image of the distinguishing attribute and surrounding region under correct register conditions; i.e. no image degradation due to bleed. The use of reference images being correlated against an on-press image to determine relative position is well known and can be found in U.S. Pat. Nos. 5,181,257, 5,946,537 and 5,412,577. These techniques can provide sub-pixel measurements which give an additional approximate factor of ten in the accuracy of the X and Y measurements. The cross-correlation process is robust in that the position of register mark 130 will be accurately determined even if it has partially lost contrast due to being completely overlaid by a different color, or if it has been partially overlaid by a totally obscuring color (such as black), with total contrast loss in the affected portion. A less-preferred method would be to cross-correlate the area 152 of unit 146 against the corresponding area 152 of a difference color unit. In the preferred form of the instant invention, despite the pixel resolution of about 0.003 inch, too inaccurate for high-quality printing register, sub-pixel image measurements are made to provide accuracies of 0.3 thousandths of an inch, within the highest quality standards for printing 0.01 mm or 0.4 thousandths of an inch.

In the case where misregister largely obscures a distinguishing attribute 130 with ink of some other color, the phase-correlation techniques of U.S. Pat. No. 5,689,425 are useful in detecting the positions of the edges of the distinguishing attribute 130 despite poor contrast. Phase-correlation does not provide reliable sub-pixel accuracy and it is preferred only in cases of severe misregister. When an approximate register correction corrects the obscuration, cross-correlation is again preferably used.

The cross-correlation of the area 152 and template will generate an X and Y value indicating the centering error of distinguishing attribute 130 in the area 152. As the position of the area 152 is known, the exact position of the distinguishing attribute 130 is therefore known by subtracting the centering error from the known area 152 position. As the distinguishing attribute 130 and its adjacent colorpatches are in a known positional relationship, the exact position of either colorpatch 68 or 70 is therefore also known.

The above process of distinguishing attribute position determination is repeated for color unit 148, except that, in the case of magenta ink, the best image contrast is obtained by using the green channel, for yellow ink, the blue channel is best used, for black ink, any channel may be used, although the green channel has a slight advantage.

The distinguishing attribute 130 position in the magenta color unit 148 is compared to the position of the distinguishing attribute 130 of the cyan unit 146. In the case of colorpatches with a width such as 0.100 inch, the expected relative position is 0.200 inch in the X (or lateral) direction and zero in the Y (or circumferential) direction. Any difference from the expected spacing represents a color register error between the cyan and magenta colors. Similar comparisons can be made for the other colors to obtain register errors between all the colors. These register errors are processed with conventional techniques to move register motors to correct for the register error.

Less preferentially, cross-correlating the area 152 against the corresponding area 152 of a different color unit would generate the relative position without the intermediate step of determining each area's exact position. This technique has half the computational load but since both rather than only one of the areas 152 may be degraded by bleed, the correlation between them is less reliable.

It should be noted that for applications where less accuracy is needed in registration control, it may be sufficient to use the edges of the standard colorpatches as the distinguishing attribute. Also, the locations of the halftone dots with halftone patches may serve this purpose.

In the preferred embodiment, the color units 146, 148, 158, 160 as shown in FIG. 4 are included in colorbar 62 at several places, particularly near the extremes of the right and left side of the web 12. Full-tone patches and 75% patches are normally used in color control. In the case of a cocking register error, a measurement of the register error on the right side of the web will disagree circumferentially with the same measurement on the left side. The difference between the circumferential measurements represents the cocking error. This error may be used to apply corrections to cocking motors which adjust the plate cylinders 24 and 28 to correct for the cocking error. Similarly, the difference between the lateral measurements represents the fit error. This may be used to adjust the bustle wheels 30 to minimize the fit error.

Many measurements of color can be taken from a colorbar 62, such as dot gain, slur, doubling, print contrast, and trap. Each of these measurements requires various types of colorpatches, and with limited space, placing distinguishing attributes 130 in every viewing location may not always be practical.

To allow for proper response to a register upset, it is known for register systems to be wired to splicers or washers so that the register system is signaled when the various upsets occur. When a signal is received indicating an impending register upset, the camera assembly 40 is preferably programmed to remain in an area of the colorbar 62 containing the color units 146, 148, 158 and 160. As proper color control cannot be performed without proper register, the color units are repetitively analyzed for misregister until the register is returned to normal, at which point the camera assembly 40 returns to scanning the entire web 12 for the additional purpose of color control. The differences between the register at the extremes of the web 12, which represent fit and cocking register, are valid only if the register does not change significantly while the camera assembly 40 is traversing across the web 12. By remaining over a single set of color units during known times of unstable register, invalid measurements of fit or cocking are avoided.

Further synergy of the register control function and color measurement functions of the invention are realized by recognizing a common cause of changes in both color density and register. Blanket wash removes semi-dried ink and paper lint from the blanket cylinders 22 and 26. The unwanted contaminants will act as ink-transferring points, giving greater color density to the image. After the wash, the image color density will decrease. While process colors cyan, magenta, and yellow will return to normal density quickly, the black density may take two to five minutes to return to within 0.2 density units of the pre-wash desired density. Less ink being transferred to the paper corresponds to less blanket follow (momentary sticking of the web 12 to the blanket cylinders 22 and 26 before the web 12 peels off and moves to the next print unit). Since blanket follow causes the web to move in a path that is not a straight line, the web 12 path is longer, causing a color register shift of subsequent colors. When the ink builds back up on the blanket, the color density increases, as does the blanket follow. The same cause of the color register change is the cause of the color density change. Press units are typically built with one blanket cylinder tilted downstream so that the web 12 reliably follows off one blanket cylinder only. In the example of the Harris-Heidelberg M-1000 series of presses, the web 12 follows the upper blanket cylinders 22.

In a preferred mode of the present invention, the above phenomenon to predict color density change by measuring color register change is utilized. This is advantageous because color register can be measured more quickly than color density. In the example of a four-color press where the printing order is black, cyan, magenta, and yellow, a lengthening of the web path due to blanket follow after the black unit, is typically on the order of 10 thousandths of an inch. This lengthening disappears after a blanket wash, associated with a decrease in density of about 0.4 density units. The lengthening translates to a retarding of the register of the black ink with respect to the other colors. The color-density increases to 0.2 below nominal within about three to five minutes, and finally to nominal in the next few minutes.

To take advantage of this phenomenon, the preferred mode of the invention reads register after a blanket wash. When register is read after the blanket wash, the retarding of the black ink is used as a quick gauge of the drop in color density. A retarding of the black register is used to command an increase in ink flow, in linear proportion to the register change. A detected change in black register of, for example, 0.005 inch, would be multiplied by a coefficient of 0.1 density unit per 0.0025 inch of register change to generate a command to increase the ink density by 0.2 density units. Although a full scan of the web would require about 30 seconds, a predictive correction of the color density can be made almost instantly.

Turning now to backup register, backup register can be determined by comparing the relative circumferential position of the upper surface colorbar 62 seen by camera assembly 40 versus that seen by camera assembly 40'. In the example where the camera assemblies 40 and 40' are spaced exactly one press revolution apart, proper backup register would correspond to both colorbars 62 being centered in the respective images with simultaneous strobe flashes at both cameras assembles 40 and 40'. The difference in circumferential position of the respective colorbars represents the backup register error. If, for example, the lower surface's colors were retarded in this situation, the backup register is corrected by advancing all the lower circumferential register motors accordingly. If the camera assembly spacing is not exactly one press revolution, the difference in strobe firing phase when the colorbar is centered in the image, times the printing plate circumference, represents the backup register error.

The invention is not limited to the specified methods of accurately determining the position of the colorpatches. For instance, although finding the colorbar is disclosed as being by cross-correlation or phase-correlation, simple stepwise, optimized position-by-position brute-force pattern matching or like methods can also be used. As the correlation technique of position determination will recognize nearly any shape, the shape of the distinguishing attributes could include stars, squares, or a variety of other shapes. The distinguishing attributes are disclosed as being between two same-color colorpatches in order to minimize the loss of significant area to any one colorpatch, but the distinguishing attributes would be as successfully recognized if they were within a single colorpatch. Although the advantage of operation without the use of separate marks would be lost, operation would succeed without the disadvantage of separate stands and scanners if the color control camera assembly scanned both the colorbar and a register determining colorpatch at a known location relative to, but distinct from, the colorbar. Also, rather than a target being a light area in a dark colorbar, the reverse could also be utilized, for example a 100% tone target embedded in a 25% colorpatch. The colorpatch need not be a solid or halftone. For example, slur targets are often in the form shown in FIG. 2 of a starburst pattern, bull's eye pattern, rising sun radiating lines, or right-angled lines, all of which colorpatches form a distinguishing attribute adequate for positional determination. If the colorbar is a continuous gray overprint as is commonly used in newspaper as described, the distinguishing characteristic could be a circle of each of the colors in an unobtrusive position such as the fold of the newspaper. These and other variants are within the spirit and scope of the claims below.

What is claimed is:

1. A method for the maintenance of color register between ink colors of a multicolor image printed on the web of a printing press, said method comprising:

determining the approximate position of a first colorpatch with respect to a colorbar;

determining the approximate position of a second colorpatch with respect to the colorbar;

comparing the position of the first colorpatch with respect to the position of the second colorpatch to generate a relative position;

comparing the relative position to a predetermined expected position to generate a color register error; and correcting for the color register error.

2. The method of claim 1 wherein the position of the first colorpatch is determined by determining the position of an attribute of the first colorpatch.

3. The method of claim 2 wherein the position of the first colorpatch is determined by cross-correlating the attribute against a template image of the attribute.

4. The method of claim 3 wherein the attribute is an uninked circle within the first colorpatch.

5. The method of claim 2 wherein the attribute is the shape of the first colorpatch.

6. The method of claim 2 wherein the position of the first colorpatch is determined by phase-correlating the attribute against a template image of the attribute.

7. The method of claim 1 and further including the acts of determining the color density of at least a portion of the first colorpatch and comparing the determined color density to a desired density to generate a density error.

8. The method of claim 7 and further including the act of adjusting an ink-dosing mechanism to correct for the density error.

9. The method of claim 1 wherein the correcting act includes moving a press register motor.

10. A method for the maintenance of color register between ink colors of a multicolor image printed on the web of a printing press, said method comprising:

capturing an image of a portion of a printed web;

finding a colorbar within the image, the colorbar including first and second register marks;

determining the position of the first register mark and the position of the second register mark;

comparing the positions of the first and second register marks to generate a relative position;

comparing the relative position to a predetermined expected position to generate a color register error;

correcting for the color register error;

determining the color density of at least a portion of a colorpatch within the colorbar; and comparing the determined color density to a desired color density to generate a density error.

11. A system for the maintenance of color register between ink colors of a multicolor image printed on the web of a printing press, said system comprising:

a camera assembly to capture an image of at least a portion of a colorbar printed on the web;

a computer containing a program to determine the approximate position of a first colorpatch included in the colorbar with respect to the position of a second colorpatch to generate a relative position by comparing the position of the first colorpatch relative to the position of the second colorpatch, and to compare the generated relative position to a predetermined expected position to generate a color register error; and a motor responsive to the color register error to correct for the color register error.

12. The system of claim 11 and further including a computer program to determine the color density of at least a portion of the first colorpatch and to compare the determined color density to a desired density to generate a density error.

13. The system of claim 12 and further including an ink-dosing mechanism which receives the density error and changes the ink dosage to correct for the density error.

14. A method of correcting register cocking error, said method comprising:

determining the positional error of a first colorpatch in a colorbar to determine a first register at a first laterally extreme portion of a web of a printing press;

determining the positional error of a second colorpatch in the colorbar to determine a second register at a second laterally opposite extreme portion of the web;

comparing the first and second registers to generate a cocking error; and correcting for the cocking error.

15. A method of correcting register fit error, said method comprising:

determining the positional error of a first colorpatch in a colorbar to determine a first register at a first laterally extreme portion of a web of a printing press;

determining the positional error of a second colorpatch in the colorbar to determine a second register at a second laterally opposite extreme portion of the web;

comparing the first and second registers to generate a fit error; and correcting for the fit error.

* * * * *